United States Patent [19]

Gallery

[11] 4,128,738

[45] Dec. 5, 1978

[54] COMPACT TRANSMISSION LINE LOUDSPEAKER SYSTEM

[76] Inventor: Thomas W. Gallery, 452 Poplar, Wyandotte, Mich. 48192

[21] Appl. No.: 727,469

[22] Filed: Sep. 28, 1978

[51] Int. Cl.[2] ..... H04R 1/28

[52] U.S. Cl. ..... 179/1 E; 181/146; 181/151; 181/156

[58] Field of Search ..... 179/1 D, 1 E; 181/144, 181/145, 146, 147, 148, 149, 150, 151, 152, 153, 154, 155, 156, 199

[56] References Cited

U.S. PATENT DOCUMENTS

| | | | |
|---|---|---|---|
| 2,765,864 | 10/1956 | Glenn | 181/151 |
| 2,926,740 | 3/1960 | Holland | 181/151 |
| 3,165,587 | 1/1965 | Alderson | 181/145 |
| 3,166,147 | 1/1965 | Greenfield | 181/145 |
| 3,592,290 | 7/1971 | Armstrong | 181/151 |
| 3,720,285 | 3/1973 | Russell et al. | 181/151 |
| 3,834,485 | 9/1974 | Doschek et al. | 181/146 |

FOREIGN PATENT DOCUMENTS

| | | | |
|---|---|---|---|
| 143597 | 9/1951 | Australia | 181/155 |
| 1215129 | 4/1960 | France | 181/156 |
| 423291 | 7/1947 | Italy | 181/156 |
| 502238 | 11/1954 | Italy | 181/151 |
| 820307 | 9/1959 | United Kingdom | 181/156 |
| 927458 | 5/1963 | United Kingdom | 181/156 |

OTHER PUBLICATIONS

Abstract of U. S. Patent Application 637,670, filed Dec. 28, 1945, H. F. Olsen et al., Made Public Nov. 14, 1950, "Sound Translating Device."

Funk-Technik, vol. 30, No. 6, p. 136, "The 'London' Ribbon Loudspeaker," Anon, Mar. 1975.

*Primary Examiner*—George G. Stellar

*Attorney, Agent, or Firm*—Alex Rhodes

[57] ABSTRACT

A compact loudspeaker system adapted for the reproduction of sound at minimum distortion. Two small diameter direct radiator loudspeakers and a matching crossover network are mounted in a common enclosure having a short non-folded transmission line completely filled with randomly oriented non-woven fibers, said fibers having a single installed density within range of 12 to 30 ounces per cubic foot. The first of these speakers, a bass/mid range unit is acoustically coupled to one end of the fiber filled transmission line by exposing the speaker radiator rear surface to the line while the second speaker, a high frequency unit, is acoustically isolated from the transmission line by encapsulating the speaker radiator rear surface in a housing integral with the second speaker. A port, located at the end of the transmission line, acoustically couples said line to the atmosphere.

11 Claims, 8 Drawing Figures

COMPACT TRANSMISSION LINE LOUDSPEAKER SYSTEM

BACKGROUND OF THE INVENTION

The loudspeaker, a major element of an audio system, radiates acoustic power into the air with resultant waves equivalent in form to an electrical input. The direct radiator type loudspeaker, almost universally used for audio systems, is deficient for reproducing low frequency sound because of its low radiation mechanical resistance. In addition, the 180 degree phase relationship between waves radiated from front and rear radiator surfaces of the direct radiator loudspeaker reduces speaker efficiency and causes distortion. Currently, speaker cones are most frequently used as radiators in direct radiating type loudspeakers.

Radiation mechanical resistance can be increased by increasing speaker radiator size, however, larger radiators add cost and may not be practical within the available space. Currently, the most common method for increasing radiation mechanical resistance is the mounting of the speaker in a cabinet, alternately referred to as an enclosure, whereby the rear surface of the speaker radiator is loaded by a volume of air. Enclosures may be designed to absorb rear radiation from the speaker radiator in part or in total, to augment reproduction of certain frequencies by phasing front and rear speaker waves or a combination thereof.

A variety of enclosure designs are available for improving performance of the direct radiator loudspeaker, the most common being the "acoustic suspension" and "bass reflex" enclosures. The "acoustic suspension" enclosure derives its name from the manner of increasing radiation mechanical resistance whereby the acoustic capacitance of a confined volume of air in a non-vented enclosure is used for supplementing the speaker radiator restoring force normally supplied by the cone suspension. In actual practice, "acoustic suspension" systems tend to be compact but inefficient and tend to distort from excessive one sided loading of the speaker radiator.

The popular "brass reflex" enclosure by phasing and coupling waves radiated from the front and back surfaces of a speaker radiator is efficient for reproducing bass frequencies. However, "bass reflex" enclosures tend to be of large size, have poor bass transient response and distort from cabinet resonance.

Radiated energy from the speaker rear cone surface could be totally dissipated by transmitting waves from the rear cone surface down a transmission line of infinite length. Since this is impractical, enclosures based on the long transmission principle have been developed. A long folded transmission line enclosure, the "acoustic labyrinth," has been further improved by lining the surfaces of the transmission line with acoustic absorption fiber materials. See Olney U.S. Pat. No. 2,031,500 which teaches a folded transmission line enclosure having acoustic absorption linings.

The transmission line length of the "acoustic labyrinth" enclosure has been reduced to 8 feet by filling the line with loosely packed wool of density range one pound per 2 to 3 cubic feet. The inventor of this improvement found higher wool packing densities and shorter transmission lines with his system to be unsatisfactory. See A. R. Bailey, *A Non-resonant Loudspeaker Enclosure Design*, Wireless World, October, 1965, and A. R. Bailey, *The Transmission Line Loudspeaker Enclosure*, Wireless World, May, 1972.

SUMMARY OF THE INVENTION

The present invention is directed toward a compact loudspeaker system adapted for the reproduction of sound at minimum distortion. Two small diameter direct radiator speakers and a matching crossover network are mounted in a generally rectangular enclosure having a non-folded transmission line 24 to 48 inches long, completely filled with randomly oriented non-woven fibers, said fibers having a single installed density within the range of 12 to 30 ounces per cubic foot. The first of these speakers, a bass/mid range unit is acoustically coupled to one end of the fiber-filled transmission line by exposing the speaker radiator rear surface to the line while the second speaker, a high frequency unit is acoustically isolated from the line by encapsulating the speaker radiator rear surface in a housing integral with the second speaker. Alternatively, multiple speakers may be used in place of the bass/mid range and high frequency units. The transmission line is acoustically coupled to the atmosphere at the end of said line opposite the first speaker.

Further features and benefits of the present invention will be apparent from the following description with reference to the accompanying drawings.

DETAILED DESCRIPTION OF THE INVENTION

Figure 1:
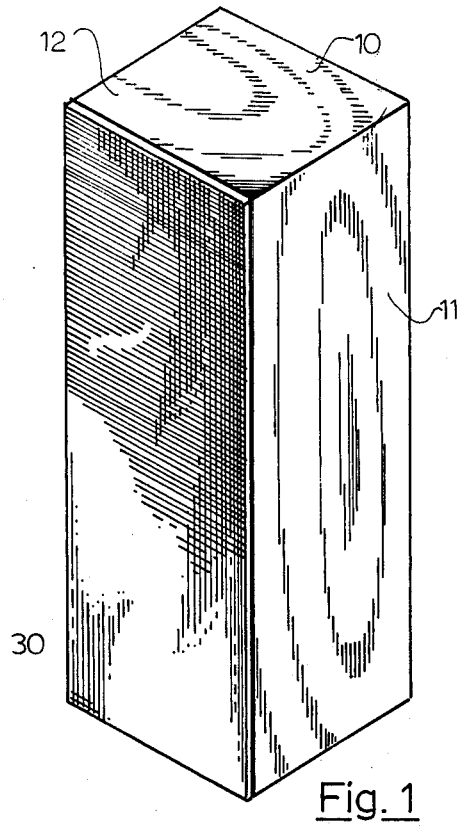
FIG. 1 is a perspective view wherein is shown the top, front and left side of the first embodiment of my invention, a compact loudspeaker system.

With reference to the accompanying drawings, the first embodiment of my compact loudspeaker system, designated by the numeral 10 in FIG. 1, is shown to have a generally rectangular enclosure 11, however, other shapes are possible within the scope of the present invention. A top panel 12, side panel 13, bottom panel 14, rear panel 15 and front panel 16, being oriented and joined at their outer boundaries as shown in the drawings make up the principal outer structure of enclosure 11. The aforementioned panels may be assembled by currently used methods, such as, adhesive bonding, screws, nails or a combination thereof. Panel materials should have their rigidity equivalent to ¾ inch thick wood particle board.

Front panel 16, commonly referred to as a baffle, is separated from bottom panel 14 in such spaced relationship so as to provide a rectangular port 17 in the lower front surface of enclosure 11. Front panel 16, optionally may be extended and joined to bottom panel 14 and a port provided by making a cut-out in front panel 16 of rectangular, circular or any other similar shape.

Two recessed areas 21 and 22, in the outward facing surface of front panel 16 are provided for flush mounting a bass/mid range speaker 18 and high frequency range speaker 19 to front panel 16. Speakers 18 and 19 extend inward through circular openings 58 and 59 into cavity 24 of enclosure 11. Speakers 18 and 19 are attached to panel 16 with screw type fasteners 25. A rectangular cut-out 26 is provided in rear panel 15 wherein is located a loudspeaker crossover network 27, said network being attached to rear panel 15 with screw type fasteners 39 and connected to speakers 18 and 19 by wires 40. Within cavity 24 are two corner reflectors 28 and 29 which extend the full width of enclosure 11, upper reflector 28 being attached to top panel 12 and rear panel 15 and lower reflector 29 being attached to bottom panel 14 and rear panel 15. Reflectors 28 and 29 eliminate standing waves and improve system performance. A decorative grille panel 30, consisting of a thin grille cloth 23 offering a low resistance to transmission of sound with its outer edges folded over and retained to frame 31 by wire staples 32 or similar means, is retained to enclosure 11 by the magnetic attraction of magnetic strips 33, said magnetic strips 33 being first retained to the outward surface of front panel 16 and magnetic strips 34 being first retained to the rearward surface of grille panel 30. Magnetic strips 33 and 34 are commercially available wherein an elastomer is impregnated with magnetic particles. Optionally, other magnetic means may be used for retaining grille panel 30 to enclosure 11. Magnetic strips 34 may be retained to front panel 16 by staples 35 or an adhesive.

Bass/mid range speaker 18 is a high compliance low distortion direct radiator speaker, 8 inches or less in diameter. Most often, the radiator for a direct radiator speaker is cone shaped and referred to as a speaker cone. As an example, the 5 inch diameter plastic cone speaker, commonly referred to as a woofer and marketed under the tradename KEF B110 type SP1003, performs excellently in my compact loudspeaker system. High frequency speaker 19, commonly referred to as a tweeter, may be any commercially available high quality small diameter direct radiator speaker designed for reproducing high frequency sound. As a companion to KEF B110, a ⅞ inch diameter mylar dome tweeter, available under the tradename KEF 27 type SP1032, was used in my compact loudspeaker system with excellent results.

Figure 3:
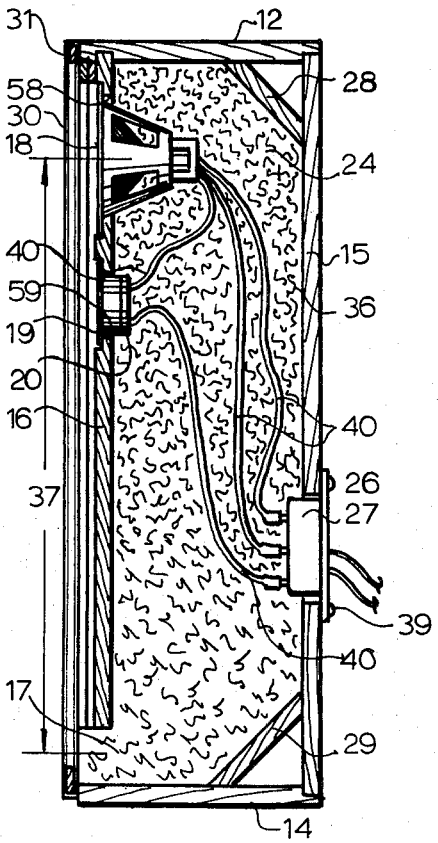
FIG. 3 is a vertical cross-sectional view taken in the direction of arrows 3—3 in FIG. 2.

Cavity 24 of enclosure 11 is completely filled with a packing medium of randomly oriented non-woven fibers 36, said fibers having an approximately single installed density within the range of 12 to 30 ounces per cubic foot. Referring to FIG. 3, it is apparent that if sound waves radiated from the radiator rear surface of speaker 18 are allowed to enter cavity 24, in order to exit enclosure 11, they must traverse the vertical path from speaker 18 to port 17. This path 37, commonly designated as a transmission line, is most clearly seen in FIG. 3. I have found that by increasing the installed density of fibers 36 to twice or more that used in existing transmission line enclosures, transmission line length can be significantly reduced. With the present invention, a direct non-folded transmission line may be used for reducing enclosure size in contrast to folded lines of other enclosures through which waves traverse a back and forth path in order to exit the enclosures.

Speaker 18 is acoustically coupled to transmission line 37 by exposing the speaker radiator rear surface to the line 37 while speaker 19 is isolated from line 37 by encapsulating speaker 19 radiator rear surface in speaker housing 20. Transmission line 37 acts as a low pass filter for rear cone radiation from speaker 18, whereby frequencies above approximately 125 Hz are absorbed and acts to reduce the velocity of transmitted frequencies below 125 Hz so that they will exit enclosure 11 with proper phasing for augmenting system bass response.

It will be observed that my compact loudspeaker system has a transmission line 37 length within a range of about 24 to about 48 inches. This has been achieved using a fiber having an installed density range of about 12 to about 30 ounces per cubic foot in conjunction with the other elements of the present invention. The particular value of installed density of fibers 36 within the range believed is dependent upon the special length selected for the transmission line 37, the type of fiber material and speaker characteristics. For example, a system showing excellent performance was constructed with a 30 inch long transmission line filled with long wool fibers of 20 ounces per cubic foot density. A longer line would have allowed a reduction in density at the expense of increasing enclosure size.

Port 17 area, in contrast to the port area of a "bass reflex" enclosure, is not critical but should exceed in value the projected area of the bass/mid range speaker 18 cone. In FIG. 7 is shown a schematic diagram of the crossover network 27 for coupling an input to the bass/-mid range and high frequency speakers of the present invention of a compact loudspeaker system. As shown in FIG. 7, the bass/mid range speaker is coupled to the input by an LC low-pass filter comprising an inductor L1 and a condensor C1, and the high frequency speaker is coupled to the same input by a CLC high-pass filter comprising condensors C2 and C3, and an inductor L2. Values as high as three times the projected cone area of speaker 18 are allowable. For crossover network 27 shown in FIG. 6, the following component value ranges are recommended: $L_1$ = 1.0 to 1.5 mh, $C_1$ = 8 to 15 mfd, $C_2$ = 3 to 5 mfd, $C_3$ = 5 to 10 mfd and $L_2$ = 0.25 to 0.40 mh. Specific values for crossover network components for optimim performance can be established by tests of the particular system. Although I have provided a recommended crossover network 27, other network designs are possible within the scope of the present invention.

Figure 6:
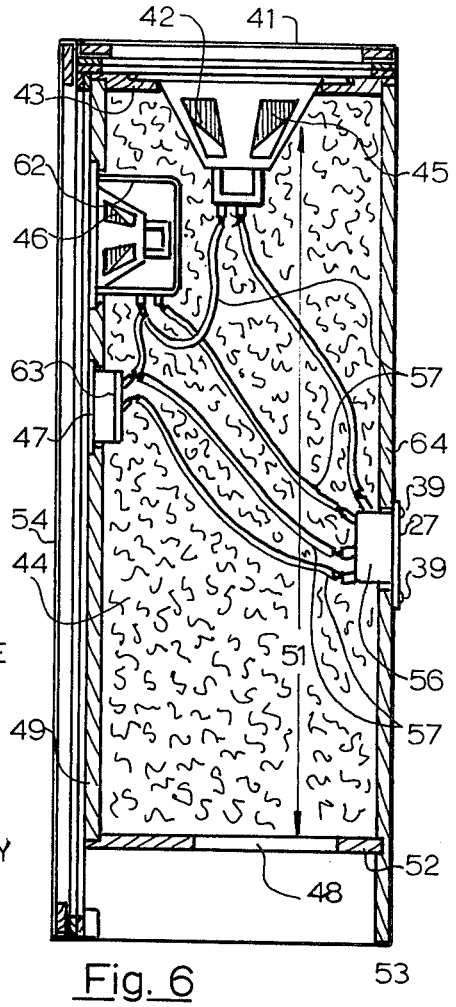
FIG. 6 is a vertical cross-sectional view similar to FIG. 3 and illustrating features of the second embodiment of my compact speaker system wherein three speakers are used and a transmission line port is provided in the bottom panel of the enclosure.
Figure 7:
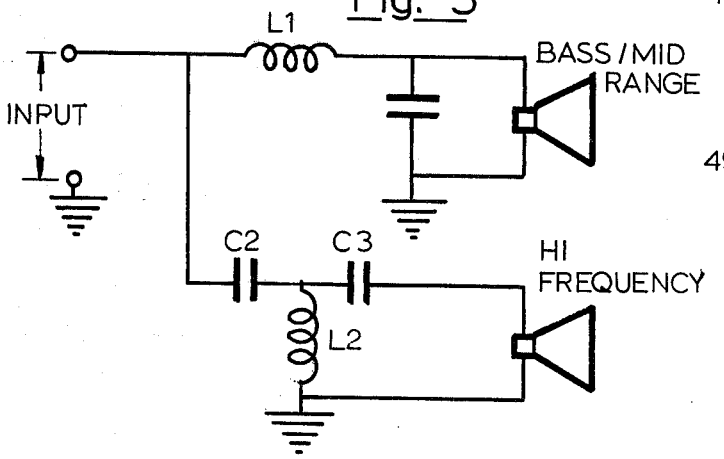
FIG. 7 is a schematic diagram of a crossover network for the first embodiment of my compact loudspeaker system to the output of an audio source.

The second embodiment of the present invention, generally designated by the numeral 41, is shown in FIG. 6, a cross-sectional view similar to FIG. 3. With the exception of the following features, other features of the second embodiment are the same in all respects to the first embodiment 10 of the present invention.

Figure 8:
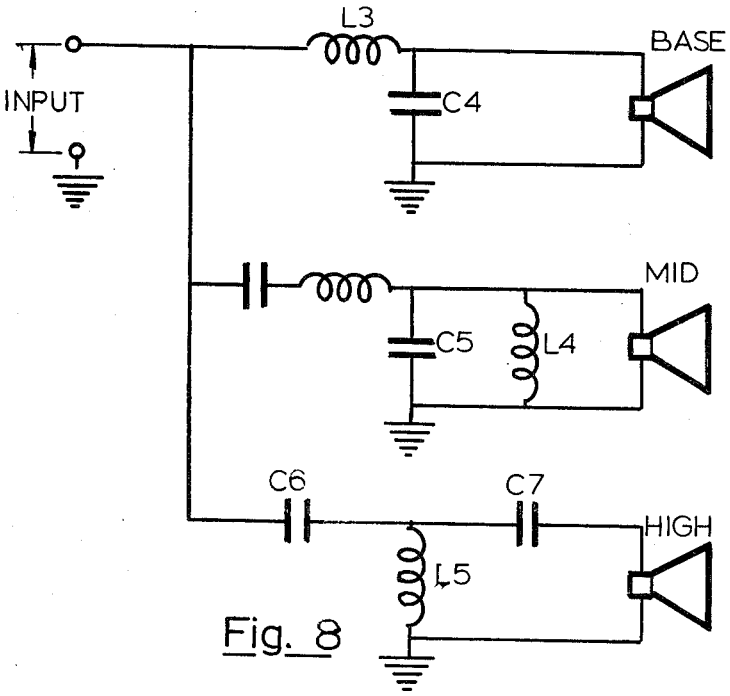
FIG. 8 is a schematic diagram of a crossover network for the second embodiment of my compact loudspeaker system to the output of an audio source.

A separate bass speaker 42 is mounted in top panel 43 and acoustically coupled to a fiber 44 filled transmission line 51 by exposing the speaker radiator rear surface 45 to the line 51. Separate mid range 46 and high frequency 47 speakers, mounted in front panel 49, are acoustically isolated from line 51 by encapsulating their radiator rear surfaces in speaker housings 62 and 63. A transmission line port 48 is provided in bottom panel 52. Side panels 53 and rear panel 64 being extended below bottom panel 52 allow exit of speaker 42 rear cone radiation from port 48. Grille panel 54 is extended to cover front panel 49 and top panel 43. A crossover network 56 of the type shown in FIG. 8 and wires 57 couple speakers 42, 46 and 47. In FIG. 8 the crossover network 56 is shown in schematic form. An input is coupled to bass and high frequency speakers by LC low-pass and CLC high-pass filters, respectfully, which are of the same circuit configuration as the low and high-pass filters of crossover network 27 in FIG. 7. For coupling the input in FIG. 8 to the mid range speaker, an LC band-pass filter is shown wherein the mid range speaker is connected to the input by an inductor in series with a condensor. An additional condensor C5 and inductor L4 are connected in parallel with the mid range speaker to provide a sharp band-pass characteristic for the mid range frequencies. As is the case with network 27, specific values for optimum performance with network 56 components can be established by tests of the particular system.

While two specific embodiments of the present invention have been shown, it will be appreciated that other embodiments drawing from individual features of the shown embodiments can be provided. For example, a remotely located crossover network may be used without regard to the length of transmission line and density of the randomly oriented non-woven fibers. Also, the decorative grille panel may be retained to the front panel by a fastening means other than magnetic.

Having now described my invention and the manner of making and using it, one can see that what has been achieved is a compact loudspeaker system adapted for the reproduction of sound with minimum distortion. What I claim is new is:

1. In a compact loudspeaker system wherein an enclosure is provided which is characterized by a short non-folded transmission line completely filled with non-woven randomly oriented fibers and the performance of said system is relatively independent of the volume of said enclosure and port area at the end of said transmission line the combination of;

a loudspeaker enclosure having a non-folded transmission line whose length is within the range of about 24 to about 48 inches;

a loudspeaker mounted on said enclosure, at one end of said transmission line, and having a radiator front surface facing exteriorly and a radiator rear surface facing interiorly of the enclosure and communicating with said transmission line;

a port in said enclosure at the other end of said transmission line having an area greater than the projected area of the radiator front surface of said loudspeaker and communicating the interior of the enclosure to the exterior; and a packing medium of non-woven randomly oriented wool fibers having a density within the range of about 12 ounces to about 30 ounces per cubic foot and completely filling the transmission line from said loudspeaker to said port whereby said loudspeaker is acoustically coupled to said port by a short non-folded transmission line completely filled with non-woven randomly oriented fibers of relatively high density.

2. In a compact loudspeaker system the combination as set forth in claim 1 including a second loudspeaker mounted on said enclosure and having a radiator front surface facing exteriorly and a radiator rear surface facing interiorly of the enclosure and means acoustically isolating said second loudspeaker from said packing medium.

3. In a compact loudspeaker system the combination as set forth in claim 2 including a crossover network comprising an input, an LC low-pass filter coupling the input with said first loudspeaker and a CLC high-pass filter coupling the input with said second loudspeaker.

4. In a compact loudspeaker system the combination as set forth in claim 3 wherein said low-pass filter has an inductance of 1.0 to 1.5 millihenrys and a capacitance of 8 to 15 microfarads and said high-pass filter has a first capacitance of 3 to 5 microfarads, an inductance of 0.25 to 0.40 millihenrys and a second capacitance of 5 to 10 microfarads.

5. A compact loudspeaker system adapted for the reproduction of sound with minimum distortion wherein a ported enclosure is provided having an acoustic circuit for the transmission of sound waves from the rear of a loudspeaker means mounted on said enclosure which is characterized by a short non-folded transmission line completely filled with non-woven randomly oriented fibers and is relatively independent in performance of the interior volume and port means area of said enclosure comprising:

a loudspeaker enclosure having a non-folded transmission line, said enclosure including a top, bottom, front, rear and pair of side panels, whereby said transmission line is formed by the interior walls of said panels;

first loudspeaker means having front and rear radiating surfaces;

means mounting said first loudspeaker means on said enclosure such that said front surface faces exteriorly of the enclosure and said rear surface faces interiorly of the enclosure;

second loudspeaker means having front and rear radiating surfaces;

means mounting said second loudspeaker means on said enclosure such that said front surface thereof faces exteriorly of the enclosure and said rear surface thereof faces interiorly of the enclosure;

port means in said enclosure communicating the interior of the enclosure to the exterior whose area is greater than the projected area of the front radiating surface of said first loudspeaker means and spaced within the range of about 24 to 48 inches from said first loudspeaker means whereby the distance of said port means from said first loudspeaker means defines the length of said transmission line and the performance of said compact loudspeaker system is relatively independent of the area of said port means;

a packing medium comprised of non-woven randomly oriented fibers having a density within the range of about 12 ounces to about 30 ounces per cubic foot and completely filling the interior of said enclosure, whereby said first loudspeaker means is acoustically coupled to said port means by a short non-folded fiber filled transmission line of relatively high density; and means acoustically isolating said second loudspeaker means from said packing medium.

6. The compact loudspeaker system set forth in claim 5 wherein said first loudspeaker means is operative over a lower frequency range than said second loudspeaker means.

7. The compact loudspeaker system set forth in claim 5 wherein the radiator front surfaces of both said loudspeaker means face in the same direction.

8. The compact loudspeaker system set forth in claim 5 wherein said first loudspeaker means comprises a single loudspeaker and said second loudspeaker means comprises a single loudspeaker.

9. The compact loudspeaker system set forth in claim 5 wherein both said loudspeaker means and said port means are located on a common wall of said enclosure.

10. The compact loudspeaker system set forth in claim 5 including a crossover network mounted on the enclosure and electrically coupled with both said loudspeaker means.

11. The compact loudspeaker system set forth in claim 5 wherein said second loudspeaker means comprises two separate loudspeakers.

* * * * *

UNITED STATES PATENT AND TRADEMARK OFFICE

CERTIFICATE OF CORRECTION

PATENT NO. : 4,128,738

DATED : Dec. 5, 1978

INVENTOR(S) : Thomas W. Gallery

It is certified that error appears in the above-identified patent and that said Letters Patent are hereby corrected as shown below:

The filing date of "Sep. 28, 1978" should be --Sep. 28, 1976--.

In column 1, line 44, "brass reflex" should read --bass reflex--.

Figure 2:
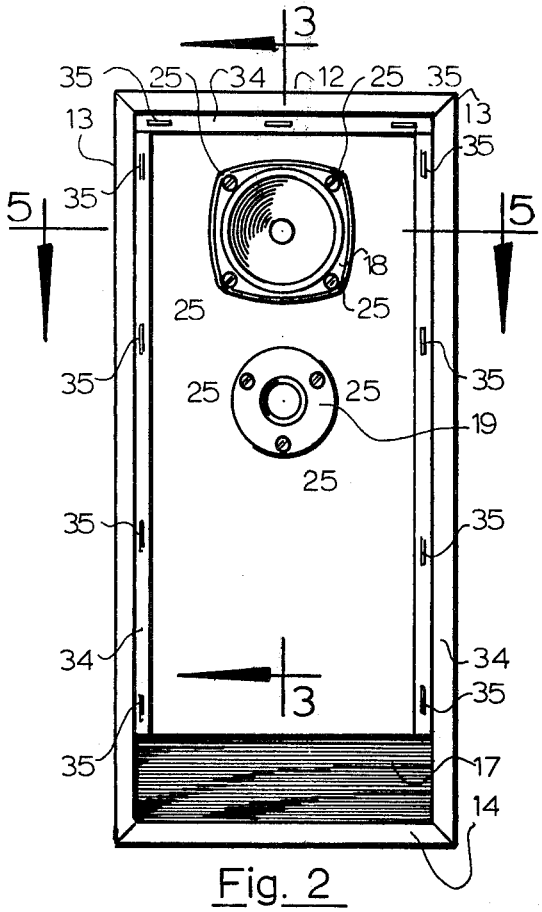
FIG. 2 is a front view of the compact speaker system shown in FIG. 1 wherein a decorative grille panel has been removed to show the appearance and spaced relationship of the loudspeakers and a transmission line port.
Figure 4:
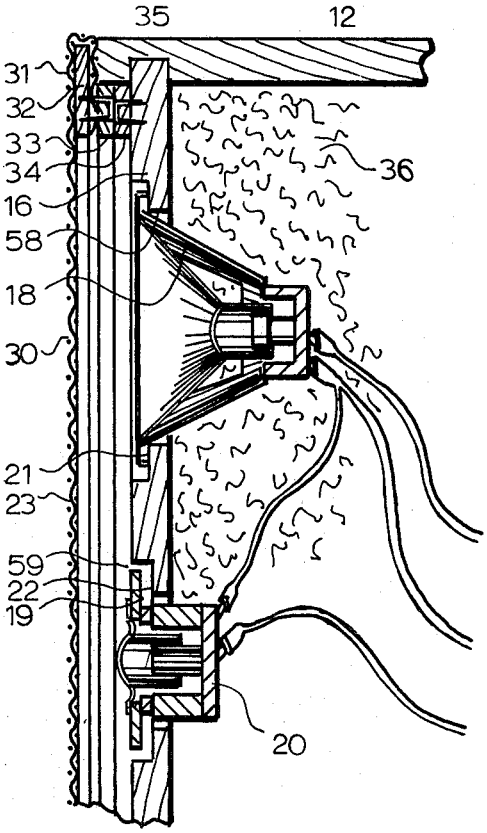
FIG. 4 is an enlarged portion of FIG. 3.
Figure 5:
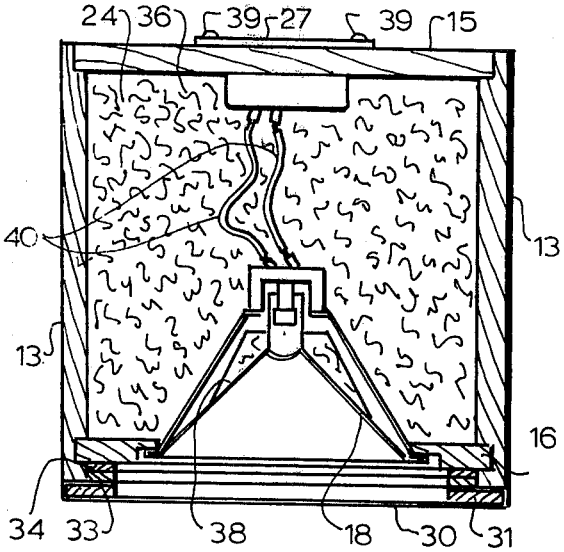
FIG. 5 is a horizontal cross-sectional view taken in the direction of arrows 5—5 in FIG. 2.

In the drawings, leaders from the reference numerals should be applied as follows: sheet 1, Fig. 1, a leader from the numeral 30 should be applied to the grille panel of loudspeaker system 10; sheet 1, Fig. 2, a leader from each of the numerals 25 should be applied to a corresponding fastener which attaches the high frequency speaker 19 to front panel 16; sheet 1, Fig. 3, a leader from numeral 26 should be applied to the rectangular cut-out in rear panel 15; sheet 1, Fig. 4, a leader from numeral 35 should be applied to the staple which attaches the magnetic strip 34 to grille panel 30 and a leader from numeral 12 should be applied to the top panel of enclosure 11; sheet 2, Fig. 5, a leader from numeral 16 should be applied to the front panel of enclosure 11; and on sheet 2, Fig. 6, a leader from numeral 53 should be applied to the side panel of loudspeaker system 41.

Signed and Sealed this

***Twenty-ninth* Day of *May 1979***

[SEAL]

*Attest:*

RUTH C. MASON
*Attesting Officer*

DONALD W. BANNER
*Commissioner of Patents and Trademarks*